US008662870B2

(12) United States Patent
Dalziel et al.

(10) Patent No.: US 8,662,870 B2
(45) Date of Patent: Mar. 4, 2014

(54) INTEGRATED PUMP FOR COMPRESSIBLE FLUIDS

(75) Inventors: Lindsay Bruce Dalziel, Aukland (NZ); Benno Frank Smit, Auckland (NZ)

(73) Assignee: Swashpump Technologies Limited, Auckland (NZ)

( * ) Notice: Subject to any disclaimer, the term of this patent is extended or adjusted under 35 U.S.C. 154(b) by 276 days.

(21) Appl. No.: 13/125,902

(22) PCT Filed: Sep. 18, 2009

(86) PCT No.: PCT/NZ2009/000198

§ 371 (c)(1),
(2), (4) Date: Apr. 25, 2011

(87) PCT Pub. No.: WO2010/047602

PCT Pub. Date: Apr. 29, 2010

(65) Prior Publication Data

US 2011/0200474 A1 Aug. 18, 2011

(30) Foreign Application Priority Data

Oct. 23, 2008 (NZ) ..... 572220

(51) Int. Cl.
*F03C 2/00* (2006.01)
*F03C 4/00* (2006.01)
*F04C 2/00* (2006.01)

(52) U.S. Cl.
USPC ..... 418/51; 418/49

(58) Field of Classification Search
USPC ..... 418/49–52, 104, 112, 140, 142–143, 418/157
See application file for complete search history.

(56) References Cited

U.S. PATENT DOCUMENTS

| | | | | | |
|---|---|---|---|---|---|
| 2,887,059 | A * | 5/1959 | Cornelius | ..... | 418/53 |
| 3,019,964 | A * | 2/1962 | Griswold | ..... | 418/53 |
| 3,323,466 | A * | 6/1967 | Ford | ..... | 418/50 |
| 4,028,020 | A | 6/1977 | Ritchie | | |
| 4,106,169 | A | 8/1978 | Gibson | | |
| 4,919,601 | A | 4/1990 | Kim | | |
| 5,242,281 | A * | 9/1993 | Hartley et al. | ..... | 418/53 |
| 5,435,705 | A * | 7/1995 | Heng | ..... | 418/53 |
| 5,454,699 | A * | 10/1995 | Heng | ..... | 418/53 |
| 6,506,012 | B2 * | 1/2003 | Tuck, Jr. | ..... | 418/53 |

FOREIGN PATENT DOCUMENTS

| | | | | |
|---|---|---|---|---|
| GB | 1103271 | 2/1968 | | |
| WO | WO 2008103058 A1 * | 8/2008 | ..... | F04C 9/00 |
| WO | WO 2008140138 A1 * | 11/2008 | ..... | F04C 9/00 |

OTHER PUBLICATIONS

International Search Report, PCT/NZ2009/000198, Dec. 2, 2009.

* cited by examiner

*Primary Examiner* — Theresa Trieu
(74) *Attorney, Agent, or Firm* — Young & Thompson

(57) ABSTRACT

A swash pump for compressible fluids uses sealing contacts made between the nutatable swash plate and the fixed cone plates to center and locate the inner swash sphere which slides against two resiliently mounted ring seals only, minimizing pump friction. A slanted end of a common drive shaft supporting and turned by the rotor of an integrated, variable speed motor causes nutation of the sphere. All bearings, especially axially slidable roller bearings inside the sphere, may settle in position with respect to the common shaft for least frictional loss. This pump is also adapted for pumping explosive gases.

11 Claims, 7 Drawing Sheets

SECTION B-B

INTEGRATED PUMP FOR COMPRESSIBLE FLUIDS

FIELD

Figure 1:
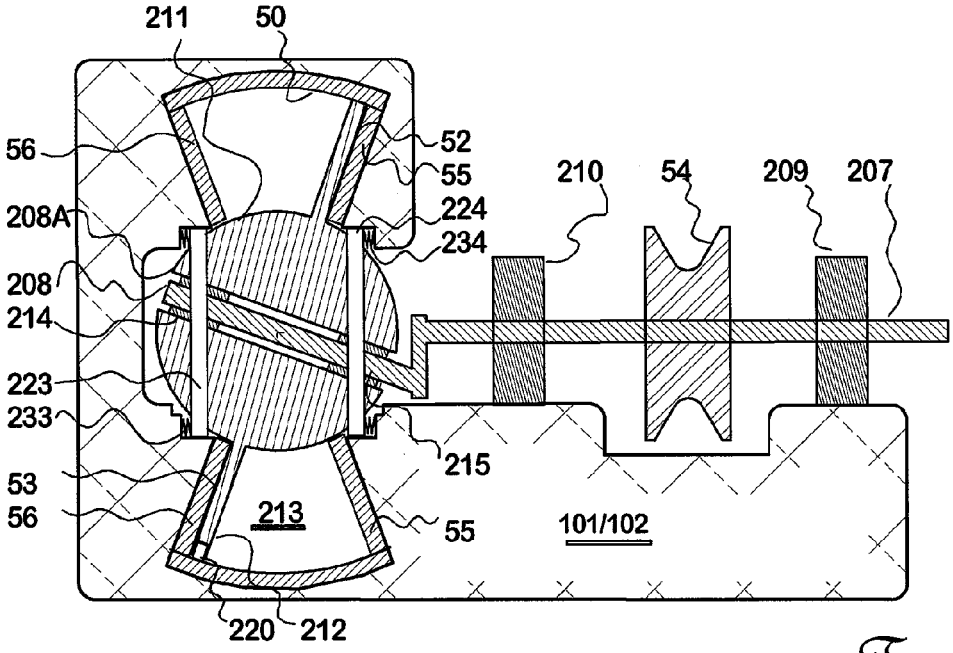

This invention relates in general to a swash pump; and in particular to a more efficient swash pump adapted for pumping a gas or a mixture of gas with liquid.

DEFINITIONS

A "swash pump" is a form of pump in which nutatory motion of a swash plate against opposing cone plates within a circular pumping chamber causes a fluid to move around the pumping chamber, from an inlet port to an outlet port.

"Nutation" refers to the peculiar orbital movement made by a swash plate inside a swash pump. It resembles the wobbling movement of a coin after being dropped obliquely on to a hard flat surface. Truly effective pumping results from nutation where the swash plate makes simultaneous contact with both cone plates at two moving "sealing lines"; one sealing line being 180 degrees apart from the other sealing line, on the opposite side of the plate. In practice, contact may be achieved on one side at any particular moment, while the other side may almost make contact. Each rotatable sealing line rotates, about the axis of the swash pump during nutation, advancing towards and past a substantially fixed, transverse divider plate, forcing fluid against the divider plate and through an outlet port.

Parts of a generic swash pump include:

"Inner swash sphere" is the visible sphere that supports the firmly attached and rigid swash plate, and which moves with the swash plate within the fixed housing. Motion is centred on the centre of nutation. The swash plate is located between the cone plates and makes contact with them during use at a movable sealing line. The inner swash sphere is concentric within an abbreviated outer swash sphere, incorporated in the pump body, located above the gap between the cone plates. A slidable seal is provided between the outer edge of the swash plate and the inner aspect of the outer swash sphere. The inner swash sphere and swash plate move in a nutating movement during use.

"Cone plate" refers to each of a pair of conic plates having a fixed, radially symmetrical, sloping inner surface facing the swash plate with which it comprises a movable line-shaped seal. The plates may comprise part of the pump housing or be insets.

The swash plate should always maintain a rotatable line-like sealing contact with the or each cone plate by means of pump construction. In the present invention, the drive shaft is slanted at just the right angle (the "slant angle"), as it penetrates the inner swash sphere and is journalled therein.

Each pumping chamber is defined by a cone plate and one side of the swash plate, by the outer swash sphere, and by the inner swash sphere, and material is moved through the pump by the moving sealing line. Both sides of the pumping chamber may be used in parallel for a less pulsatile output, or separately, by suitable porting arrangements.

"Trunnion" refers to a sliding bearing which creates an effective seal between the nutating swash plate and the fixed divider plate that intersects the cone plates and the swash plate.

"Engineering plastics material" as used herein refers to advanced inorganic compounds, alloys and mixtures capable of being formed to close tolerances. They are tough, strong, and suitable for sliding seals, having low friction and low wear. Such plastics are typically alloys comprised of a base plastic (55 to 70% ratio) selected from a range exemplified by polyethyletherketone (PEEK), polyphenylenesulphide (PPS) preferred for the trunnion, or polyphthalamide (PPA) (currently used on the other sliding surfaces) alloyed with polytetrafluorethane (PTFE), carbon, carbon fibres, and sometimes silicon, and are injection mouldable. Commercially available examples include ~Fortron 7140A4 (Polyplastics, Japan), "UCL-4036 HS" (Sabic, Saudi Arabia) or equivalents as well-known to those skilled in the art.

BACKGROUND

Swash pumps, engines, or flow meters with nutating disks have been known for more than 50 years. Yet only one commercialized swash pump, ("Genta"™ Fristam; Hamburg, Germany; based on patents by Heng and Thomas) is known. All of the prior art incurs a good deal of sliding friction particularly between the inner swash sphere and the opposing part-spherical sections of the housing, which results in high frictional losses, especially when pumping gases. Gas provides less lubrication than a liquid at the contacting faces of any seals or fluid exposed bearing faces. The frictionally generated heating is added to localised adiabatic heating when pumping a gas which itself detracts from cooling functions. Previous designs of swash pump have relied on precision manufacture to hold parts in close or sliding proximity for improved sealing, but are vulnerable to distortion of parts by thermal expansion and then possible pump seizure. Unlubricated wear also causes short parts life.

In particular, use of a rigid swash plate assembly with a rigid inner sphere, firmly yet slidably held between part spherical cavities, prevents true self-centering of the swash plate from occurring with respect to the opposing cone faces in response to manufacturing tolerances and thermal expansion, even though there may be a resiliently-mediated bias towards contact. The prior art design leads to high inner spherical contact friction and poor swash to cone sealing.

The present invention will be described in relation to a vapour extraction application inside a fuel dispenser, in order to illustrate a pump that is effective when used to pump a fluid. A vapour recovery function is a regulatory requirement imposed in an increasing number of countries. Explosive gas mixtures are required to be removed from the vicinity of the pump nozzle while a vehicle tank is being filled. The volumetric displacement of gas by this pump must by law or regulations be proportional to the volume delivery of liquid fuel. A relatively small tube ending in the nozzle head, within an outer metal tube or a rubber boot surrounding and sealing the vehicle tank opening is run along or inside the hose to the nozzle and is connected to the pump which usually returns the vapour to the vapour space above a fuel storage tank where condensation may occur and any excess air or vapour is exhausted through a carbon filter vent far from the fuelling event. Since the fuel/air mixture being pumped is flammable and explosive, the pump must not comprise a danger or detract from safety in any way. It is desirable that the pump neither causes any flame or explosion nor transmits any flame or explosion from the exterior or nozzle environment into the storage tank or visa versa.

At the present time, vapour recovery pumps use rotary vanes (Healy, USA), impellers, roller vanes (Pignone, Italy) or piston pumps (Durrtechnik, Germany). These pumps are relatively inefficient, some are noisy, and cannot handle slugs of liquid effectively. A "slug" of liquid is the liquid that will arrive at the pump from time to time, such as if the tank is over-filled or the filling pipe becomes full. A swash pump will cope with this circumstance.

PRIOR ART REVIEW

For swash pumps, Griswold U.S. Pat. No. 3,019,964 and Cornelius U.S. Pat. No. 2,887,059 teach an integrated electric motor driving a non-rotating inclined shaft, fixed to the nutating plate, through an external bearing assembly. Cornelius, and Heng U.S. Pat. No. 5,454,699 use a flexible bellows element as a seal and to prevent swash plate rotation. Hartley, U.S. Pat. No. 5,242,281 uses either a non-rotating slant stub axle; or a slant sleeve around a straight axle. Yun (WO2008/140138) has a loading spring like that of Heng U.S. Pat. No. 5,435,705 as an alternative way to impose resilience on the swash/cone contact. Hartley places a resilient part between the straight driving shaft and the interior of the spherical base of the swash plate, within the slant shaft and can drive the pumps such that the wobble angle would cause the cone angle to be exceeded except that the difference is taken up in the resilient member.

A coated swash plate is known from Ford U.S. Pat. No. 3,323,466 ("glass fibre" coating), Hartley (one example) and Yun (one example) as a resilient or as an elastic damping component but is not described as a friction reducing component. Despite the reduction of friction being of importance for swash pumps, few if any innovative solutions for friction reduction have been disclosed. Choice of materials and of surface finish is reasonably obvious. Yun teaches use of replaceable wearing parts made of a very hard steel but accepts friction as a cause of wear, rather than seeking to directly reduce friction.

No prior art is known in which the inner swash sphere is held apart from the part-spherical sliding bearings that are part of, or are firmly attached to, the pump housing. In all the known art, the inner swash sphere is rigidly mounted against the pump housing by means of sliding surfaces. No prior art is known in which a swash pump is adapted for use in fuel vapour recovery applications. No prior art is known in which a swash pump employs the cone plate faces as the primary determinants for positioning the inner swash sphere.

PROBLEM TO BE SOLVED

To provide a useful swash pump as a functional unit; preserving the inherent advantages of a swash pump such as a steady output flow and low noise while overcoming at least some of the sliding frictional losses that have been regarded as typical of this type of pump.

OBJECT

The object of this invention may be stated as to provide an improved swash pump, as a positive displacement pump for a compressible fluid, or at least to provide the public with a useful choice.

STATEMENT OF INVENTION

In a first broad aspect, this invention provides a swash pump adapted for pumping a compressible fluid, the pump having a nutatable inner swash sphere having a central axis and joined to a circumferential swash plate; the inner swash sphere having an axial aperture capable of receiving driving means; the swash plate is sealably confined within a dual, circumferential pumping chamber defined outwardly by a fixed part-spherical surface comprising the outer swash sphere, at each side by a fixed, conical or cone plate; inwardly by the inner swash sphere, and at a beginning and an end by a fixed divider plate which sealably transects the swash plate between the or each inlet port and the or each outlet port; the fluid being admitted from an inlet port then caused, when in use, by nutation of the inner swash sphere to be transported around a side of the pumping chamber towards the divider plate by one of two moving lines each providing substantially complete closure of the pumping chamber between a side of the nutating swash plate and an adjacent, substantially parallel contact line of a cone plate until the fluid reaches an adjacent outlet port, each line herein named a "sealing line"; one sealing line always 180 degrees apart from, and on the other side of the swash plate, from the other sealing line; wherein (a) the swash plate is biased into nutation in order to maintain said at least one sealing line by a force maintained against the inner swash sphere, said force being exerted from within the axial aperture of the inner swash sphere by a slanted section of a common drive shaft formed at an angle to a straight section of the common drive shaft; said slanted section being rotatably but not axially supported within said axial aperture; said straight section being rotatably supported in fixed relation to a housing of the swash pump;

(b) when in use, the inner swash sphere is located in space along the slanted section of the common drive shaft substantially by a resultant of a force effectively arising at each sealing line against a corresponding cone plate; bearing means for supporting the inner swash sphere against the pump housing being absent, so that friction during use is minimised; and (c) the or each pumping chamber is sealed with respect to the inner swash sphere by means of a sealing contact formed against the inner swash sphere by one of an opposed pair of circular sealing means resiliently supported from the pump housing, so that during use friction is minimised.

In a first related aspect, contact at the or each sealing line is made through a non-resilient layer or coating placed between each side of the swash plate and the adjacent cone plate; said layer having a low-friction characteristic, so that during use losses arising from friction acting on the swash plate at the or each sealing line are minimised.

In a second related aspect, the bias causing the swash plate to form the respective sealing line is applied through resilient means at least partially surrounding the slanted portion of the common drive shaft and inside the axial aperture; said resilient means allowing a greater yet more consistent closing force to be applied at each of the sealing lines than in the absence of said resilient means.

Preferably the greater force is set by the exact angle of the slanted shaft in relation to the angle and position of the cone face sealing lines; and is dependent on a specific application for the integrated swash pump.

In a major subsidiary aspect, the swash pump comprises part of an integrated pump intimately joined together with an electric motor; the motor and the pump sharing the straight section of the common drive shaft; wherein the common section is coaxial with a rotor of the electric motor and passes substantially through the motor; the straight section is rotatably supported by a first bearing means secured to the pump housing and by a second bearing means secured to the motor, thereby also supporting the rotor in relation to a stator of the electric motor.

Preferably the bearing means provided for the slanted section and the straight section of the common drive shaft allow axial movement of the shaft through any of the bearing means during use, so that any change of location of the inner swash sphere is capable of causing movement of the slanted portion of the common drive shaft and in turn of causing axial movement of the straight portion of the common drive shaft; said axial movement having an effect of reducing friction arising from axial forces applied to any bearing means during use, and of allowing said one or both sealing lines to substantially determine the position of the inner swash sphere and the axial position of the straight portion of the common drive shaft.

Preferably roller bearing means support the inner swash sphere on the slant shaft within the axial aperture; said roller bearing means being capable of sliding along the shaft during use, so that movement of the slanted section and hence indirectly of the straight section of the shaft arising from a change of position of the inner swash sphere is unobstructed and friction arising during use from misaligned bearings or from a mis-centered inner swash sphere and swash plate with respect to the pumping cavity cone faces is avoided.

In a related aspect, the resilient layer surrounds the slanted portion of the common drive shaft inside the axial aperture of the inner swash sphere and is comprised of a series of ring-shaped resilient members, each placed in a corresponding circumferential groove within an outer roller bearing race, and held within the axial aperture.

In an alternative aspect, the resilient means is located outside the slanted portion of the drive shaft and inside an inner roller bearing race located inside the axial aperture of the inner swash sphere.

In a subsidiary aspect, the slanted portion of the common drive shaft inside the axial aperture within the inner swash sphere includes directional resilience means, said directional means comprises (a) an inner roller bearing race having an axial slotted aperture in a sliding fit over a slanted portion of the common drive shaft bearing diametrically opposed, flattened sliding surfaces; said slotted aperture including two spaces perpendicular to the flattened surfaces each capable of retaining a resilient means in compression against the slanted shaft; the retained resilient means thereby made capable of exerting directional resilience in an axial plane parallel to the plane of the diametrically opposed, flattened surfaces; said directional resilience being superimposed on the bias applied from the slanted drive shaft on to the swash plate.

Preferably the directional resilience is directed by forming the diametrically opposed, flattened surfaces in a plane parallel to a plane shared by the axis of the straight portion of the common drive shaft and the axis of the slant portion of the common drive shaft, so that, when in use, the directional resilience is aligned with, and rotates with, the sealing lines formed between the swash plate and the two cone plates.

In a further related aspect, the divider plate comprises a fixed peripheral section and a movable central section joined together by means of a telescoping joint biased apart by resilient means; the central section extending inward from the peripheral section and pressing against the surface of the inner swash sphere adjacent the position of a trunnion; the central section being provided with a concave bearing surface having substantially the same radius as that of the inner swash sphere so that the central section forms an effective seal between inlet and outlet ends of each side of the pumping chamber yet friction arising from contact between the sphere and the concave face of the divider plate is minimised.

In a subsidiary aspect, the fixed peripheral section of the divider plate is comprised of a first rigid material having a low coefficient of sliding friction against the slot of the trunnion, while the movable central section is comprised of a second rigid material having a low coefficient of sliding friction against the surface of the inner swash sphere.

In a second broad aspect, the invention provides an integrated motor and swash pump, wherein the integrated assembly is adapted for pumping inherently explosive gases; wherein the swash pump and the motor are separately confined within secure housings each equipped with means for confining any flame or explosion occurring within; said means including:

(a) use of elongated flame arresting means, namely close clearances and seals, along joints between components of the housing, and (b) provision of a flame-arresting mesh device within the or each port of the pump within the housing of the pump, and (c) confinement of the drive shaft within a first flame trap formed by an elongate metal surround comprising part of the pump housing, and a second flame trap formed by an elongate metal surround comprising part of the motor housing, (d) electrical connections are made to the integrated motor though glands capable of preventing transfer of flame or explosion, and (e) the tip of the first section of the drive shaft is electrically connected to the spherical base of the swash plate by means of a conductive sliding contact, thereby ensuring that the drive shaft is at the same electrical potential as the swash plate.

Preferably the outer periphery of the swash plate is also provided with an outer ring seal, so that an effective seal between the outside (sphere) of the chamber and hence both pumping chambers is maintained yet with minimised mechanical friction. Preferably this is done with a pretensioned peripheral sealing ring.

Preferably the number of shaft seals in contact with the rotating common shaft is minimised; there being one running on the first section of the shaft mounted in the inner swash sphere to retain bearing lubricant, and one at the commencement of the second section of the common shaft leading to the motor, so that total friction between the rotating shaft and seals is reduced.

Accordingly the diameters of said shaft seals may be reduced.

PREFERRED EMBODIMENT

The description of the invention to be provided herein is given purely by way of example and is not to be taken in any way as limiting the scope or extent of the invention. The words "comprising" and "including" should not be taken as limiting the scope or range of any description.

DRAWINGS

FIG. 1 illustrates the principles of the present invention.

Figure 2:
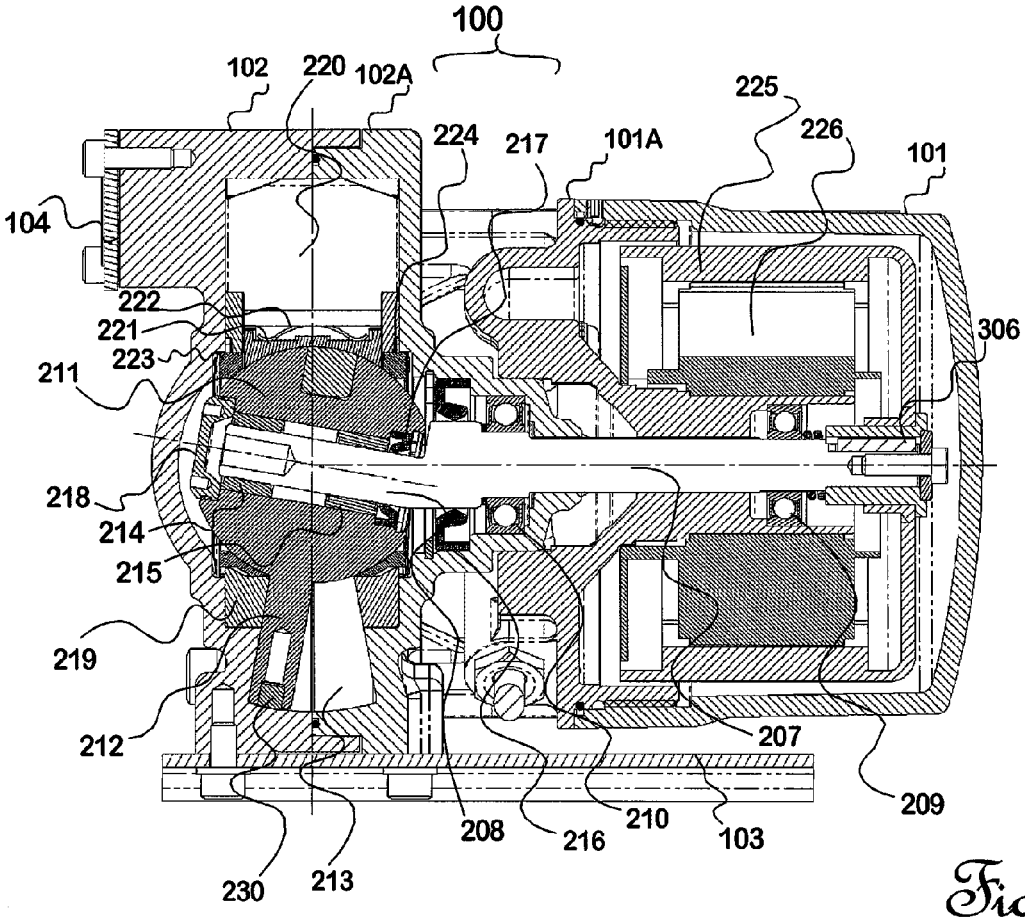

FIG. 2: is a longitudinal section through the integrated A05 style pump and motor.

Figure 3:
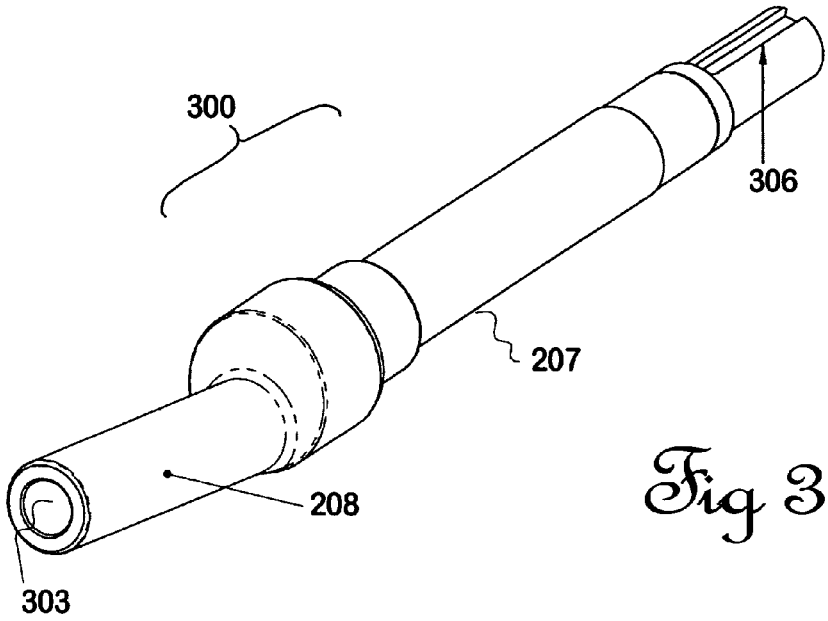

FIG. 3: is a perspective view of the common, slanted drive shaft.

Figure 4:
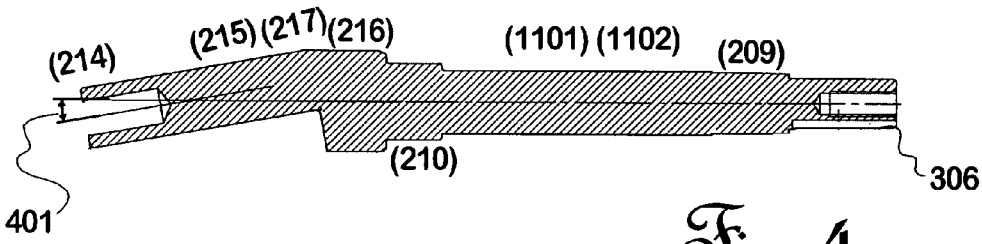

FIG. 4: is a section through the common, slanted drive shaft.

Figure 5A:
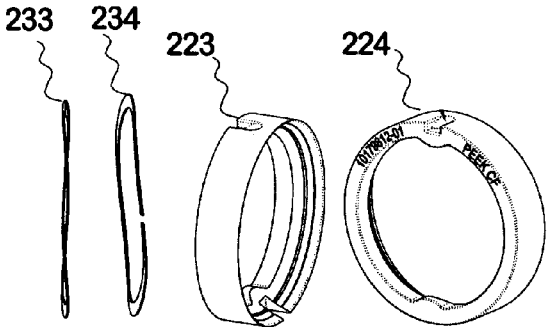
Figure 5B:
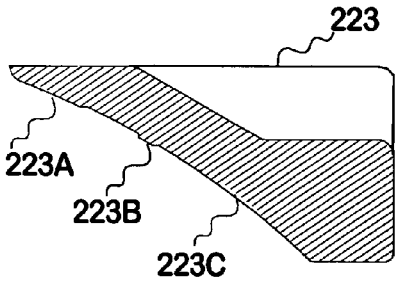

FIG. 5: as 5(*a*) shows the rigid plastic inner swash sphere seal rings and their backing wave springs. 5(*b*) is a magnified cross section through the curvature of the concave seals profile.

Figure 6:
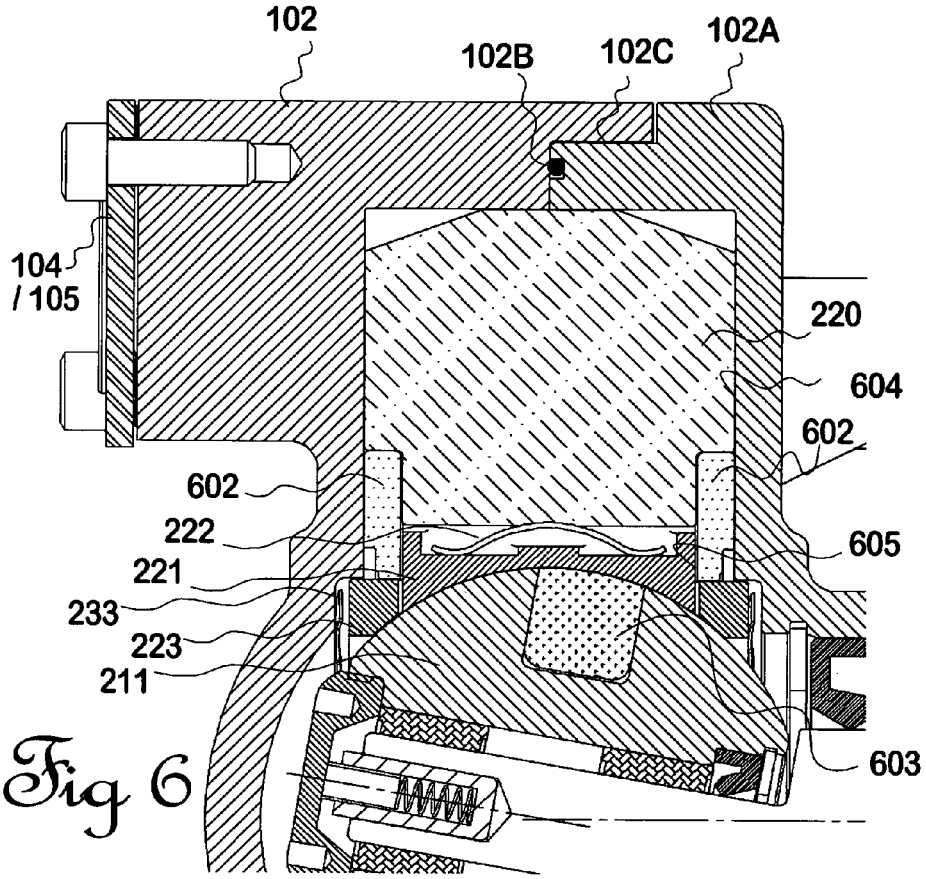

FIG. 6: is a longitudinal section through the divider plate with a sprung divider seal mounted below the plate.

Figure 7:
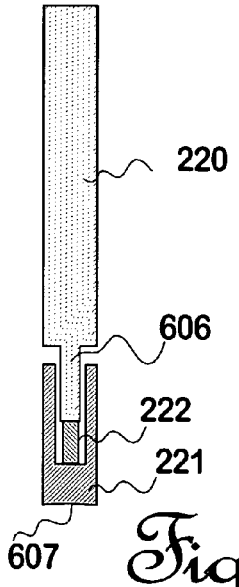

FIG. 7: is a cross section through the divider plate assembly including spring and divider seal (normal to the direction shown in FIGS. 2 and 6).

Figure 8:
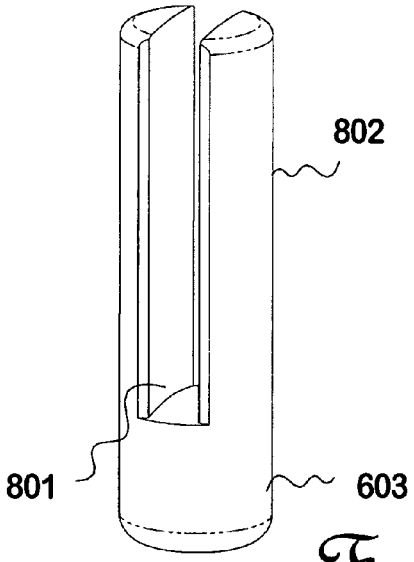

FIG. 8: is a perspective view of the trunnion bearing and seal.

Figure 9:
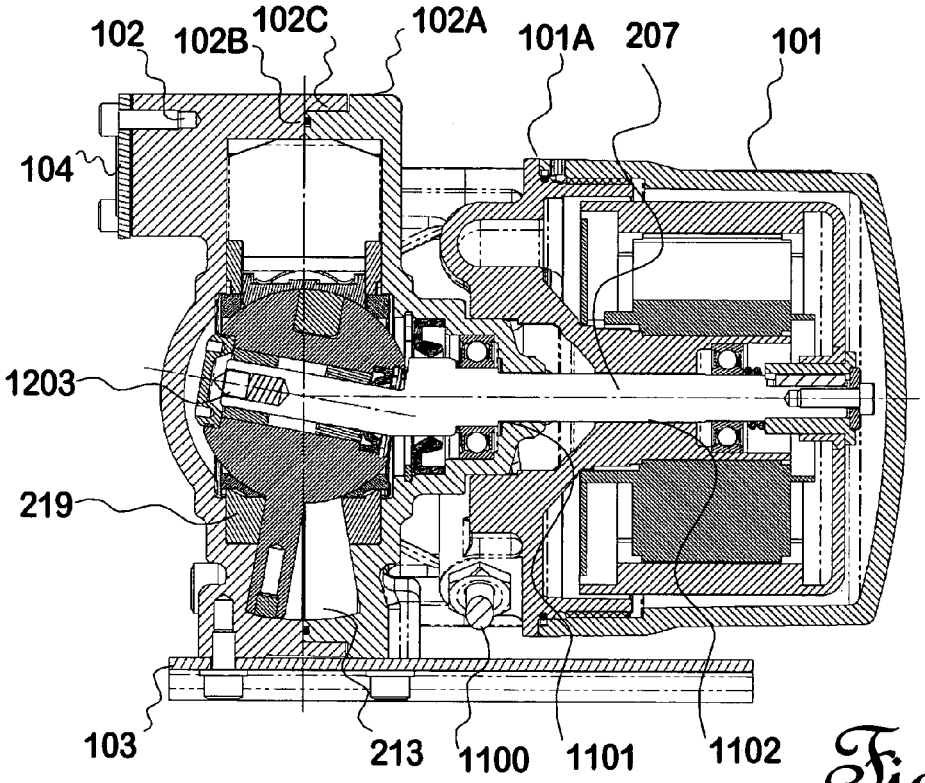

FIG. 9: illustrates flame and explosion proofing in a longitudinal section.

Figure 10:
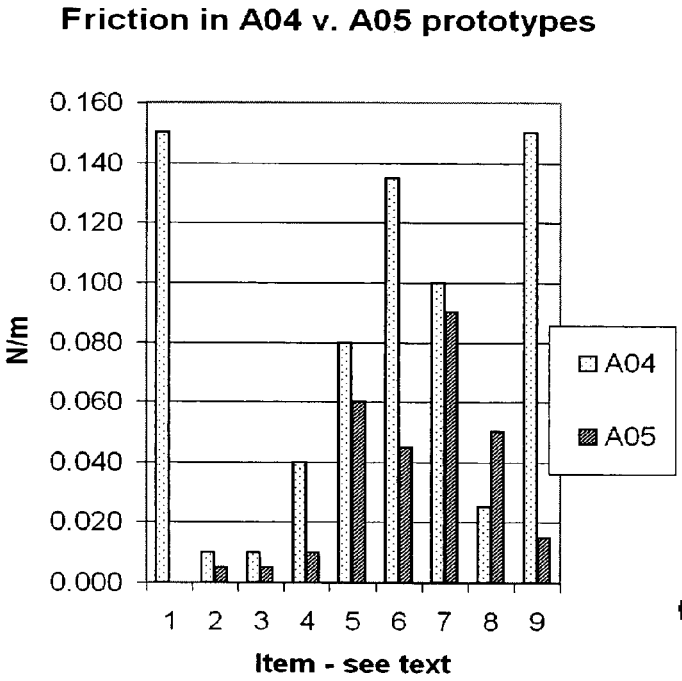

FIG. 10: is a bar chart comparing frictional drag in an earlier A04 prototype against the current A05 alpha production pumps.

Figure 11A:
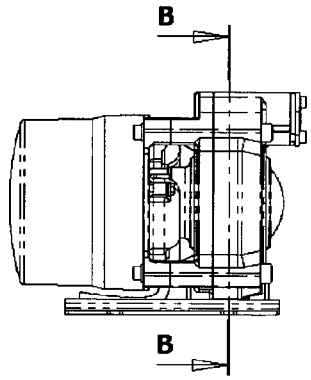
Figure 11:
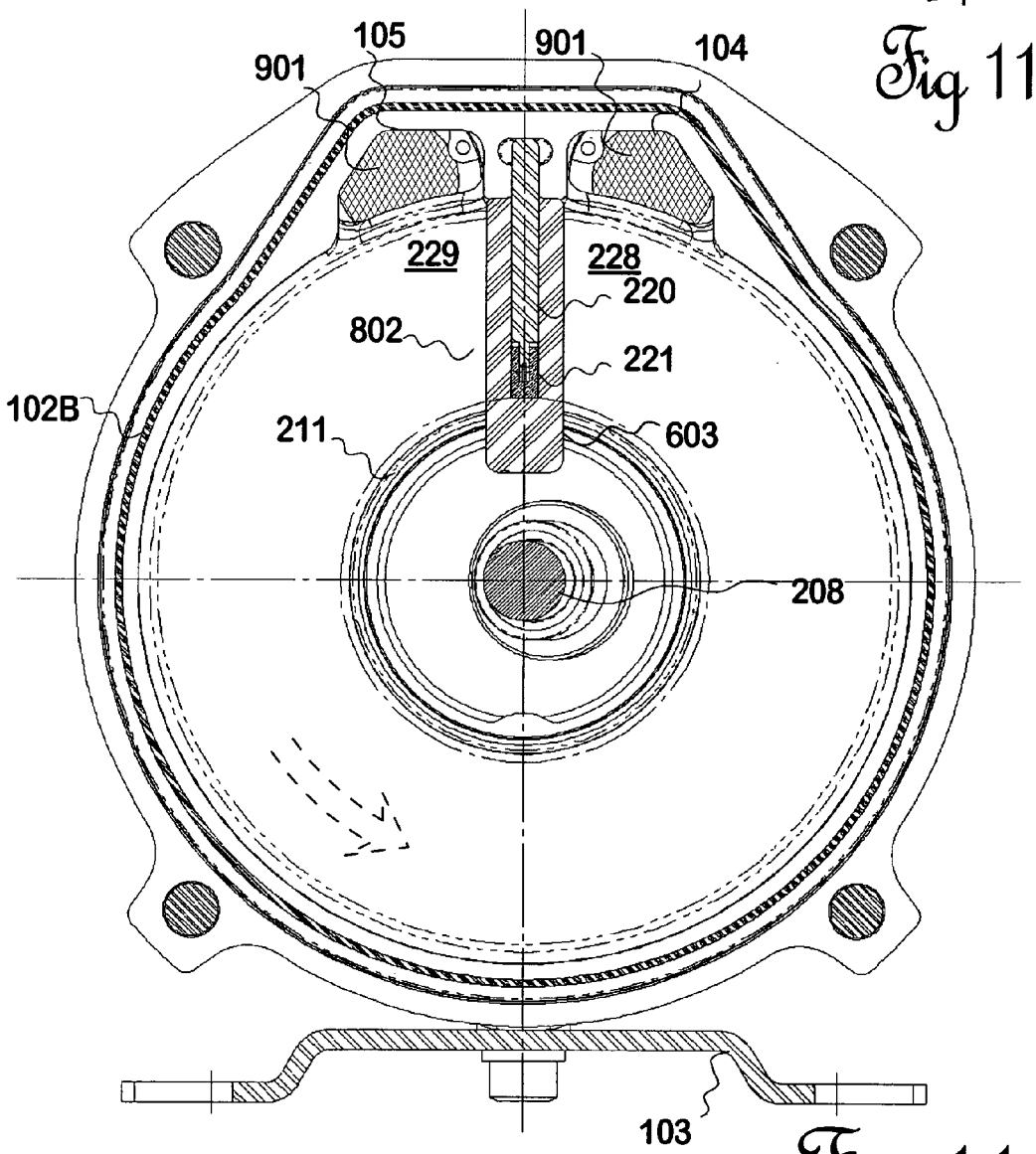

FIG. 11: is a section of an assembled pump to show the divider/trunnion in place. The swash plate is not included for clarity. (FIG. 11*a* shows the plane from which the section is taken).

Figure 12:
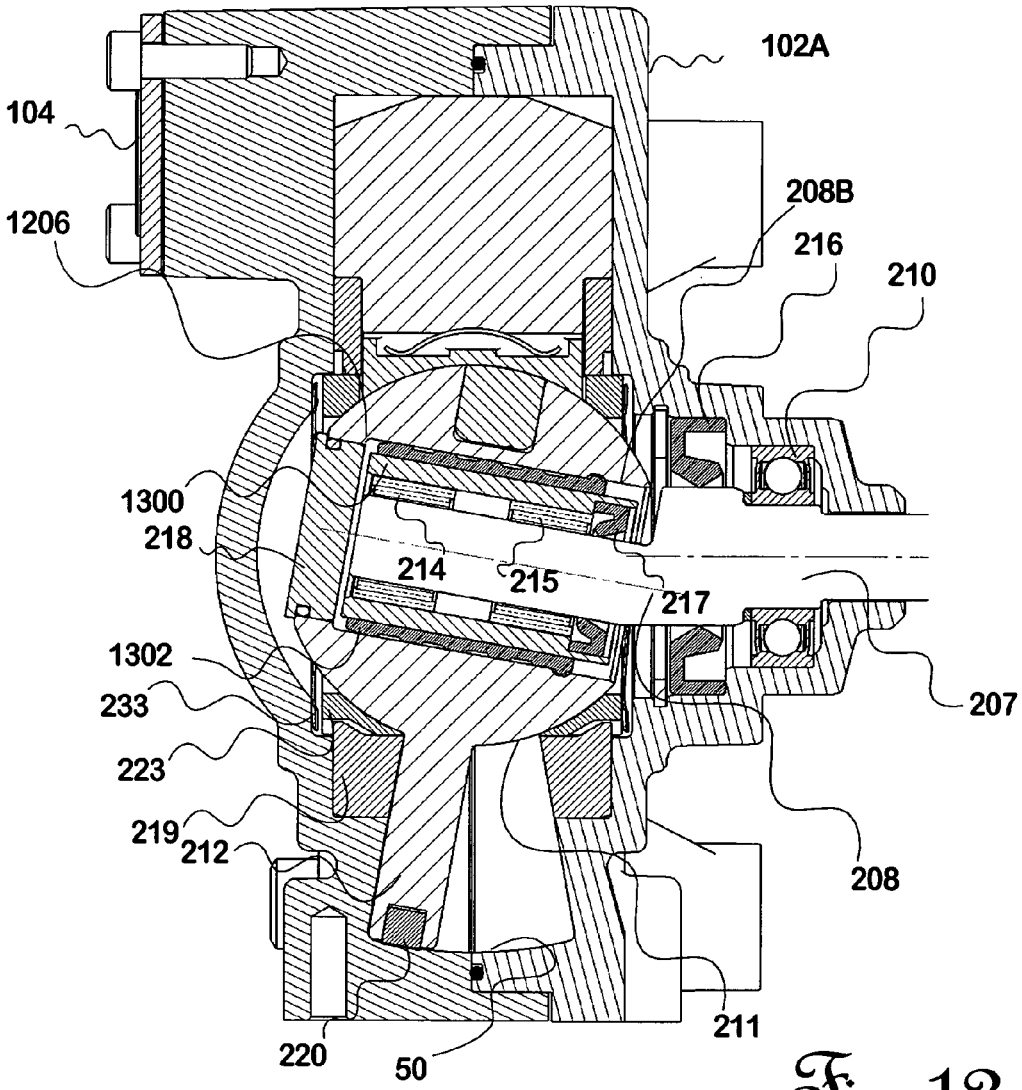

FIG. 12: shows a non-directional resiliently mounted roller bearing set inside sphere 211

Figure 13:
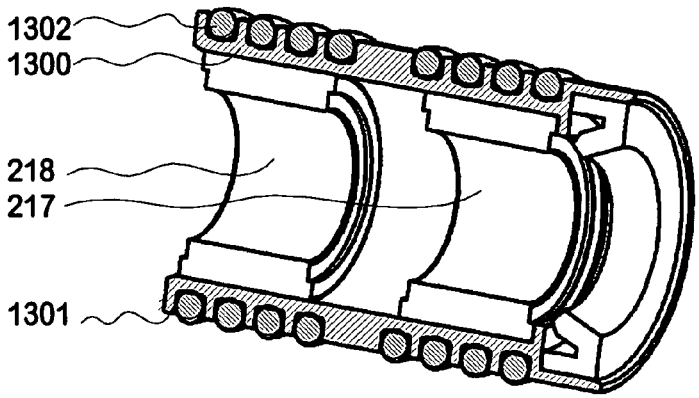

FIG. 13: shows an isometric cross section of a prototype roller bearing housing for non-directional resiliently mounted swash plate.

Figure 14:
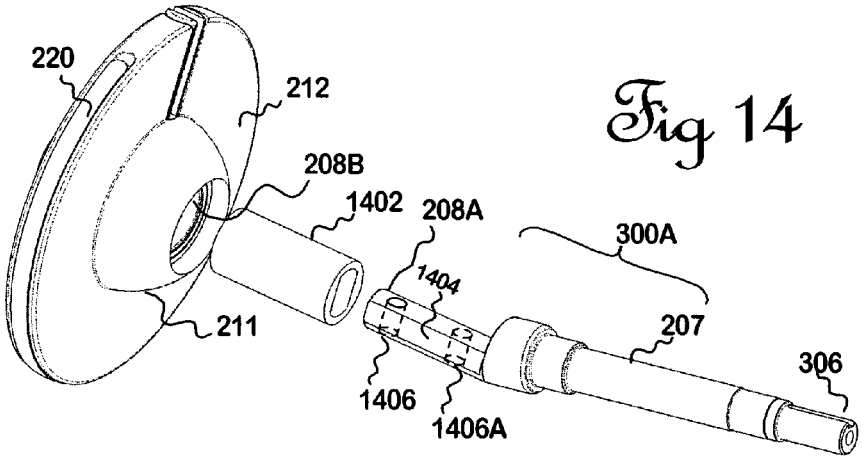

FIG. 14: is an exploded view of a common shaft and a directional resilient coupling.

Figure 15A:
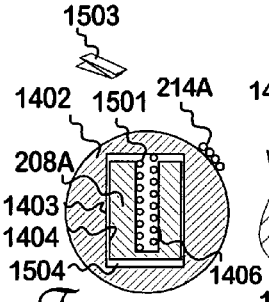
Figure 15:
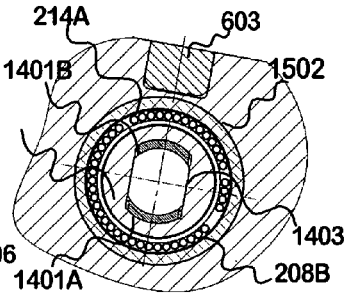

FIG. 15: is a cross-section through a directional resilient coupling.

FIG. 15*a*: is a cross-section through another directional resilient coupling.

Figure 16:
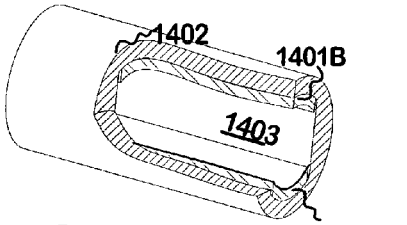

FIG. 16: is a partly opened directional resilient coupling.

Figure 17:
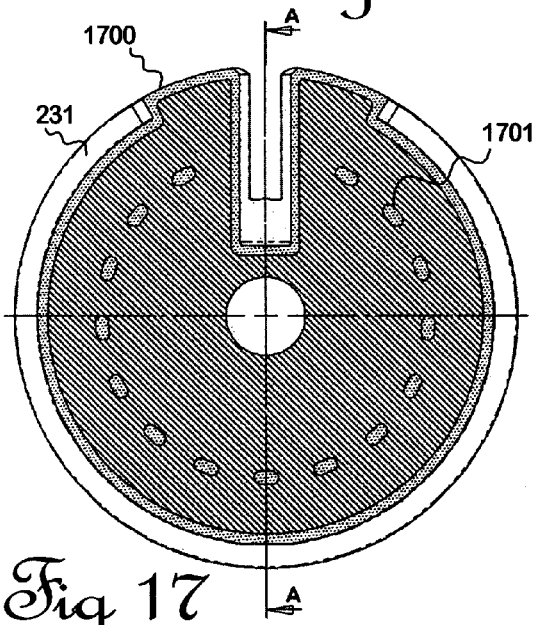

FIG. 17: is a cross-section view through the centre of an over moulded swash plate.

Figure 18:
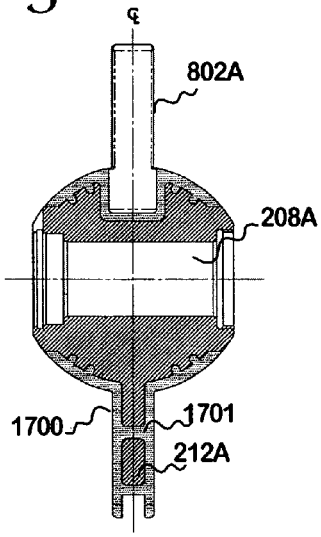

FIG. 18: is a cross-section through the centre of an over moulded swash plate perpendicular to FIG. 17.

This swash pump, preferably supplied with an integrated electric motor, is optimised for pumping compressible fluids; gases and foams, although it will pump liquids as expected from time to time in the example application of a vapour removing pump in a fuel dispenser.

EXAMPLE 1

FIG. 1 illustrates the structural principles of the present invention. This sectional diagram assumes a 20 degree slant angle for illustrative purposes. Housing or base 101/102 is a frame to fix the parts in relation to each other during use. Pumping chamber 213 encloses a swash plate 212 attached to the periphery of an inner swash sphere 211 having an axial aperture 208A 285 surrounding a rotatable drive shaft 208. The outer edge of the swash plate is preferably sealed by sealing ring 220 against a partial outer swash sphere 50 inside chamber 213. Pressure imposed by the slant angle that is included in the common drive shaft 207/208 is, since the straight section 207 is rotatably held against the housing or base by the bearings 209, 210, transmitted from the slanted part through bearings 214 and 215 to swash plate 212, pressing the plate against the inner side of each cone plate 55, 56 hence forming two movable sealing lines shown in this section at 52, 53. The two sealing lines approximate (as for all swash pumps of this class) a rolling contact which will bear the thrust loads including the fluid pumping forces with minimal, though some friction. The cone plates and the outer swash sphere are usually machined surfaces of the housing. The straight part 207 of the common drive shaft is rotatably mounted by preferably just two supporting bearings 209, 210 mounted on the frame. A slanted part 208 of the shaft passes through bearings 214 and 215 inside sphere 211. When driving means such as example pulley 54 cause the shaft 207 to rotate, sphere 211 carrying swash plate 212 is forced to nutate, causing the sealing lines to rotate around the pumping chamber and hence moving a fluid through the pump. Note that inlet and outlet ports, and a divider plate 300 assembly are not shown here.

The principles of the present invention include that:

1) Inner swash sphere 211 is not directly supported against the housing 101/102, but is free to move to and fro between the resiliently mounted seals 223 and 224. The instantaneous location of sphere 211 inside the pump is set by the moveable sealing line contacts between the swash plate sides and the cone plates, which are fixed to the housing.
2) In this invention, the inner swash sphere is not positioned as a result of direct sliding contact against a concave part support from the housing.
3) Sphere 211 is able to move axially along the slanted shaft 208 by which it is driven, as a result of selection of suitable roller or DU type bearings, for example.
4) Sphere 211 must experience a resultant vector of thrust forces derived from sealing contact lines between the swash plate and both cone plates, as a result of the angle built into the common drive shaft, and the space between the cone plates. The sealing force is dependent on the construction of the swash pump. The angle of the slanted shaft is substantially the same as the slant of either cone plate, assuming a straight-sided swash plate; so that each sealing line is comprised of parallel facing surfaces; one flat: one conical. The sealing force may be made more compliant by optional inclusion of an interposed resilient means (see later and FIGS. 12-16). The sealing lines against the cone plates bear the majority of the pumping thrust load.
5) Such contact forces may be symmetrical about the centre of sphere 211 if reactions from pumped fluids are absent and contact is made at both sides simultaneously. Sphere 211 may slide along slant shaft 208 thereby positioning the swash plate in response to the vector sum of these forces.
6) Two ring seals 223 and 224, adjacent sphere 211 are lightly pushed against sphere 211 by backing springs 233, 234 supported against the housing 101/102, and serve to isolate the pumping chamber from the surrounding environment. These seals are located at about the position where the inner swash sphere supports that have been noted in all prior-art swash pumps are placed but, being resiliently and lightly supported, they do not fix the position of sphere 211. We have noted that the engineering plastics ring seals show very little wear after extended use.
7) Preferably, the straight portion 207 of the common drive shaft is also free to slide axially within bearings 209, 210 so that sphere 211 and slanted shaft 208 are free to take up an optimised position within the pump primarily in response to the forces acting on the swash plate and in turn on the swash sphere. The instantaneous forces arising from both sealing line contacts on the swash plate combine to determine the position of the inner swash 335 sphere. The locus of the centre of the inner swash sphere will coincide, within reasonable tolerance, with the intersection of the axis of the slanted part of the shaft 208 and the axis of the straight part of the drive shaft 207. The slanted part is permitted to shift axially inside the bearings 214 and 215, relative to the inner swash sphere, to reach a position which also minimises loads on these bearings, when in use.

Note that the moving sealing lines against the two cone plates also serve as the axial reference position for the entire common shaft, since the slanted part moves the remainder of the common shaft with it, unless one of the bearings 209 or 210 prevents axial movement, as selected for some purposes. During use, the shaft will settle in a position where the sum of all the forces is minimised. This freedom of movement continuously compensates for any dimensional variations of the assembly (including thermal expansion), and comprises a significant friction-reducing aspect of the invention. It is considered by the inventors that this self-aligning function is particularly useful in making a nutating plate pump that not only has low friction but also has good pump cavity sealing characteristics. Unnecessary thrust loading of the common shaft bearings is avoided. The design avoids application of thrust loading from the inner swash sphere on to an inner spherical bearing of the housing, which is generally characteristic of the prior art. Bearing misalignment is avoided since no more than two bearings on the same shaft are held firmly in alignment. Swash pumps used to pump gases, as compared to pumps for liquids, are prone to thermally caused expansion of components caused by adiabatic compression of gases, relative lack of cooling by the pumped fluid, and inevitable mechanical friction. Use of suitable material combinations in this invention for contacting faces such as the swash to cone sealing contact avoids high component wear rates.

We have made frictional drag tests, as described in FIG. 10, on a 10 degree slant swash pump shown in section in FIG. 2, which is a design consistent with the diagram of FIG. 1. The current 360 pump (A05) was compared against an earlier prototype (A04) which had few if any of the friction-reducing aspects herein described under consistent test conditions of 1500 revolutions per minute, while pumping 90 normal liters.min$^{-1}$ of air against a 200 millibar differential. The total drag of the A04 pump was 0.7 Nm while the total drag of the A05 pump was 0.28 Nm. The temperature rise of the A05 pump during use was less than 20 deg C. despite a lack of cooling fins or the like.

The vertical scale of the bar chart indicates the drag or resistance to turning caused by friction, as a torque in Newton/meters. For test purposes specified components were temporarily deleted in turn. Item 1 compares the drags causing by firmly positioning the inner sphere 211 (A04), or not (A05). Item 2 reports the first seal (223) of the A05 version, mounted against the swash 370 inner sphere with light resilience only, and item 3 reports the second, complementary seal. The rolling bearings used inside the sphere are compared as item 4. Item 5 compares the shaft seal 216 placed around the common shaft and item 6 compares the shaft seal 217 placed around the slant shaft. The seal 230 around the periphery of the swash plate is item 7, scuffing or rolling friction of the swash plate against the cone plate is shown as item 8, and the contribution made 375 by the bearings (209, 210) supporting the common shaft are compared as item 9. In relation to item 9, it seems likely that the A04 pump had badly located bearings. We would expect all prior-art swash pumps for gas to resemble the A04 prototype regarding frictional drag.

Absence of a rigid sliding support for sphere 211 is responsible for much of the frictional reduction shown in FIG. 10. As described in relation to FIGS. 2, 6 and 7, the seal 221 under the divider plate also makes light contact only with the inner swash sphere. The seal 230 at the periphery of the swash plate (item 7 in FIG. 10) also makes light contact but the "swept area" for this seal is inherently large. Long-term test runs have shown very little wear upon the sealing surfaces of seals 220, 221, 223 and 224.

FIG. 2 shows an integrated assembly 100 including a motor (at the right, inside housing 101) having a straight or coaxial drive shaft section 207, firmly fixed to the slanted section of the drive shaft 208 of the integrated swash pump shown at the left, inside housing 102 with a port 104 at upper left. That common drive shaft is shown separately in FIG. 3. The straight section 207, is supported by two roller type bearings. One of these bearings 209 (preferably a roller ball bearing) is located inside the motor, firmly fitted in a cavity concentrically placed within the stationary motor housing 101A near the end of the common drive shaft. The other bearing 210 is included in the pump housing 102A. 103 is a base plate or mounting plate.

Several constraints fix the instantaneous position of the inner swash sphere 211 within the pump. These include the sealing lines between the swash plate and the cone plate faces, the seal at the fixed divider plate 220 (which prevents rotation of the swash plate) and the slanted portion of the common drive shaft, which maintains, and on rotation moves the sealing line contact or contacts. The straight section 207 of the shaft is preferably free to slide axially through bearings 209, 210 in order that movements made by the sphere 211 along shaft 208 result in minimised axial forces along the shaft and, as described in relation to FIG. 1, the primary determinant of the preferred running position of the shaft is contact made at one or both sealing lines by the swash plate against 180-degree separated portions of the cone plates.

A circular rotary shaft seal 216 surrounds the straight or central portion close to the origin of the slanted portion, 208, of the common shaft. The slanted portion extends substantially through the central axis of the inner swash sphere 211 and thus supports the inner swash sphere 211 by cylindrical roller type bearings 214 and 215. Those bearings are sealed from the space 405 that is inside the pump but isolated from the pumping chamber 213 by seals 223 and 224, by sliding (rotary) oil seal 217 around the slanted shaft and by a closed cap 218 at the far end. Long-life seals are preferred. If the pump is exposed to hydrocarbons that may attack normal grease, resistant lubrication such as PTFE-based or polyglycol based lubricants may be used. An optional conductive brush may be installed to ensure electrical grounding across the bearings and prevent spark erosion, shown here at the end of the slant shaft. Conductive grease may be used in the bearings 214 and 215 if required.

The circumferential swash plate 212 is preferably manufactured together with the inner swash sphere 211 as a single part. The pumping chamber 213 encloses the swash plate 212 after assembly. The swash plate is transected once at the fixed divider plate, against which it slides to and fro beneath a seal 221 inside the trunnion 802 and under the fixed divider plate 220; see FIGS. 6 and 7 for details. Each cone plate face, comprising a side wall of the pumping chamber, provides a concentric, conically sloping surface 52, 53 (FIG. 1) made parallel to the swash plate surface when held by the slant shaft in a sealing contact at a sealing line. The swash plate 212 includes a peripheral resiliently mounted ring seal 230 made of a slidable engineering plastics material, pressing against the inside of the part-spherical outer swash sphere 50 (see FIG. 1); a shape that is preferably machined or otherwise formed into both mating halves of the pump housing 102, 102A. The divider plate provides a collection point or barrier for diverting pumped fluids brought by the nutating swash plate and moving seal towards an outlet port 104. Although port 104 is usually the outlet port, the pump is inherently reversible since there are no one-way valves (at least in the preferred option) and the preferred motor is also reversible. Therefore port 105 may instead be the outlet port.

Several options for the swash plate/cone plate surfaces in frictional contact at the moving sealing lines are under test. Nutation of the swash plate inherently includes some sliding contact with the cone plates, which varies depending on the position of the swash plate in the pumping cycle. Such contact may cause wear over time if certain surface material combinations are used. An engineering plastic such as "Fortron", PPS or its alloys, or PPA or its alloys, rubbing against metal is usually preferred. As one option a concentric plastics insert 219 shown in FIGS. 2 and 12 is machined to have a conical surface parallel to but very slightly proud of the surface of each cone plate so that the insert carries the contact load and makes a sealing line contact with a metal swash plate. Alternatively, an over-moulded swash plate (see FIG. 17 and FIG. 18) coated with an engineering plastics is used in contact with metal cone plate surfaces to reduce friction at the sealing contact line. FIG. 17 is a median cross section parallel to a face of the swash plate. The layer of coating plastics material 1700 shown as a dot hatch also passes through a set of apertures 1701 from side to side of the swash plate. 231 is the space occupied by a circumferential sealing ring. FIG. 18 shows a perpendicular cross section through the lines A-A in FIG. 17, showing the overmoulded layer 1700 over and penetrating through holes made through the swash plate core 212A. This drawing includes the trunnion bore 802A and the central aperture 208A. Overmoulding is a cheap process with good precision. The resulting swash plate is lighter than a steel version, and the metal skeleton within (212A) retains a desired stiffness.

Ideally both sides of the swash plate, 180 degrees apart, would simultaneously make a moving sealing contact at the sealing lines all the time. In use it has been noted, as far as we can determine, that either but not both of the two sealing lines is likely to make contact at any instant during nutation especially with a pumping load present. The other sealing line remains almost in contact. It is believed that the factors preventing simultaneous contact include (a) additional cone to cone clearance (separation distance) in the cavity required to cope with manufacturing tolerances, and (b) differential force caused by the pressure of the contents of the pumping chambers. The swash to cone plate contact tends to occur closest to the outlet port (i.e. the leading pumping chamber contacts) which is due to the floating nature of the swash on the slanted shaft 208 and the very similar pumping pressure on both sides of the swash plate. This is likely to be because the trailing pumping chamber (180 degrees behind) has more swash plate area exposed to the very similar pumping pressure hence it produces more force and tends to push the swash plate onto the cone plate of the leading chamber. To impose extra pressure by making the slanted end of the common drive shaft with a slightly greater inbuilt angle may result in excessive friction and wear if no resilient element (such as one of those described in relation to FIGS. 12-16) is included.

As described with reference to FIG. 1, the inner swash sphere 211 is provided with two part-spherical ring seals 223 and 224 resiliently pushed against the polished metal surface of sphere 211 by a spring force wave washer 233, 234. Washers and ring seals are shown in isolation in FIG. 5(*a*) or in place in FIGS. 1 and 12. Each ring seal separates the pumping chamber from the interior cavity of the pump. The ring seals are made of a low-friction engineering plastics material. Sphere 211 has a smoothly polished metal (typically cast iron) sphere surface. As shown in the cross-section FIG. 5(*b*), each spherical seal is preferably manufactured with one or more slightly protruding circular ribs (223A at the seal periphery close to the pump cavity and also 223B close by) extending outward from the main concave spherical surface 223C. The rib surfaces have the same radius as that of the inner swash sphere 211. After extended test runs, very little wear was seen on the spherical sealing rings. The combination of (a) a smaller inner swash sphere which should preferably be less than 50% of the diameter of the swash plate periphery, (b) light sliding contact only at the resiliently mounted ring seals and (c) smaller shaft lip seals 216, 217 all contribute to the low friction characteristic of the swash pump of this invention. Both ring seals move in unison, together maintaining a light sealing line contact against the nutating sphere 211 whenever the sphere moves in response to movement of the swash plate as it touches either or both fixed cone plate faces.

The motor and swash pump share a single common shaft 300 as shown in particular in FIGS. 3 and 4, having a straight portion 207 and a slanted portion 208. The preferably single-piece integrated shaft is machined from steel by turning the slanted end when held in a suitable jig after initial turning of the straight or motor (207) section of the shaft. The slant is provided at a currently preferred angle of 10 degrees (401) to the axis of this second shaft section assuming that 10 degrees is also the angle of each cone plate surface. If a resilient component is included; preferably between the slant shaft and the sealing lines, the shaft angle may be slightly more; 10.2 degrees, for example. The shaft is then hardened and all surfaces are finally ground to the required tolerance. Optionally, the shaft could be made of separate components fastened together at a selected angle 401, if that is more practicable. Driven rotation of the common portion of this shaft 207 causes attached swash plate 212 to nutate, via the slanted shaft end 208, slidably embedded by roller bearing means 214, 215 in an axial aperture 208A entering the inner swash sphere 211.

FIGS. 3 and 4 show positioning of various parts over the naked shaft 300 as follows: end aperture 303 holds an optional spring-loaded carbon brush assembly to ensure that the shaft is electrically grounded with respect to the inner swash sphere. (214) and (215) are the locations of two slidable roller bearing assemblies over the slant stub axle 208; (217) is the location of the slant shaft rotary oil seal, for retaining lubricant within the roller bearings and (216) is the site of a shaft rotary oil seal for protecting the ball bearing assembly (particularly 210). 1101 is the zone closely covered (without contact) by the metal pump housing to achieve a first flame arresting gap—see also FIG. 9; (1102) is the zone closely covered (without contact) by the motor base to create a second flame arresting gap, (209) and (210) are the positions of two preferably axially slidable (see below) deep-groove ball or equivalent roller bearing assemblies that also serve as a main axial bearing for the outer rotor 225 of the motor, and 306 is the keyway which transmits the torque from the motor rotor to the common drive shaft. It is considered that a pair of bearings inside the inner swash sphere is preferable to using a non-rotating slant shaft coupled to one or more external bearings as used in much of the prior art. Apart from simplifying construction, lowering the parts count, ensuring bearing alignment and substantially reducing frictional losses, this integrated design assists in making the assembly more compact. In an example embodiment (A05) the common drive shaft is approximately 161 mm long. The complete integrated motor and pump takes up less space than any comparable motor and pump combination used in the fuel vapour recovery industry.

The inventors prefer that the common shaft can within limits slide axially through all bearings in this invention, while complete support of radial loads is maintained, in order that the swash plate, by making contact with the cone plates, initially determines the position of the nutating and rotating parts. Therefore, none of the bearings are press fitted on to the common drive shaft although the diameters of the shaft at these bearing locations are closely matched to the bearing internal apertures so each bearing still properly supports the drive shaft radially. The straight section 207 of the drive shaft is allowed to float in an axial direction inside the inner race of both the deep groove ball bearings 210 and 209 in this option. Any inadvertent thrust set up between the bearings is eliminated, and friction is typically reduced by a further 3-5%. In one option the inner ball bearing races have been lightly sprung loaded against each other to prevent internal ball skid within the bearing which would prolong bearing life if required and also assist in the performance of the pump if it was to be mounted vertically with reference to shaft direction rather than the preferred horizontal orientation. Electrically conductive bearing grease may also be preferred to extend bearing life.

A reader skilled in the art will appreciate that the weight of the rotating parts will bias the above loading arrangement if the pump is not operated with the shaft horizontally aligned, which may have a biasing effect on the position taken up by the sphere 211 and the shaft 207/208. The importance, if any, of this effect has not been established. The axial component of magnetic attraction between the motor stator, when energised, and the rotor may also bias 530 the common shaft position if the motor is not assembled in magnetic alignment. In such cases, one of the common shaft bearings (209 or 210 may be fixed during manufacture on to the shaft for a penalty of perhaps 5 percent of the total frictional loading. Alternatively the magnetic attraction effect may be used to at least partially overcome the effect of gravity on the common shaft.

This integrated motor and pump includes an optimised approach to providing bearings for the rotating parts of a swash pump. The preferably paired needle roller bearings 214 and 215 are free to slide lengthways over the slanted portion 208 of the common shaft. Only two ball-roller bearings (209 and 210) are used to support the straight part of the common shaft 207. One (209) may be supplied as part of the motor and one (210) is included in the pump housing.

Use of a resilient element having compliance between the slant section 208 of the common drive shaft and the swash plate assembly permits more force to be consistently imposed on to the sealing lines and hence allows for more consistent closure of both sealing lines 52 and 53 (see FIG. 1), as compared to a completely stiff and rigid coupling. Use of a resilient element also allows the angle of the slant shaft to be constructed at an angle greater than the angle of either cone plate, by for example 0.1 to 0.5 degrees so that the line of contact between cone plate and swash plate is biased towards closure by a controlled and relatively constant force. The resilient coupling helps to provide that the cone plates on opposite sides of the swash plate will be contacted simultaneously by the swash plate at the sealing lines, inherently improving sealing of the pump cavity. Less manufacturing precision is needed, expansion and wear are better tolerated, and any suspended particles in the pumped fluid are better tolerated. Individual units in a manufactured batch will exhibit more consistent performance. Use of a floating common shaft assembly further ensures that the forces within the resilient mount assembly will equilibrate in a symmetric manner, prolonging the life of all components.

One variant of the invention having non-directional resilience, as shown in FIGS. 12 and 13, surrounds the slanted shaft with a resilient component assembly. FIG. 12 shows a section through a cylindrical sleeve of a resilient material as the mass 1302 between the outer race 1300 of the bearing 214 and 215 over the slanted section 208 of the common drive shaft. The sleeved assembly is pressed into the axial hole 208B bored into or through the inner swash sphere. The force that tends to close the sealing lines is transmitted through the resilient material from the slanted section 208, that in turn is held in place by the bearings 209, 210 around the straight section of the common drive shaft. FIG. 13 shows in isometric cross section a modified outer race 1300, which bears a number of circumferential external grooves 1301 for holding individual rubber rings 1302. These are typically standard or modified "O"-rings of selected dimensions and materials (rubber or analogous elastomeric substances, optionally hydrocarbon-resistant materials). After assembly the outer race bearing rubber rings is forced into the hole 208B (see FIG. 12) within the inner swash sphere 211 so that the rubber rings are under compression. The amount of resilience is determined by the selection of the type and size of the rubber rings, which may be replaced or upgraded in the field. Unlike resilient parts used in some prior-art swash pumps, the amount of resilient travel provided with this coupling can be strictly limited. The elastomeric material may be bridged by metal to metal contact if overloaded. In this version, the elastomeric material is cycled through compression and back with each revolution of the drive shaft, which could result in a change of characteristics over time.

For a preferred, directionally resilient, drive mechanism, the slant shaft and inner bearing race is modified. FIG. 14 depicts a modified shaft 300A in which parallel, diametrically opposite flats 1404 with a smooth finish are formed along the length of the slant shaft portion 208A. To serve as the inner bearing race, a hollow cylinder 1402 is fabricated with an internal aperture including parallel, diametrically opposite flats 1403, which have just sufficient clearance, and a suitable finish, to slide over the flats 1404 on the slant shaft 208A. The internal aperture also 580 includes spaces 1504 (see FIG. 15*a*) perpendicular to the flats, giving some freedom for shaft 208A to twist while sliding inside sleeve 1402. Sleeve 1402 also comprises the inner race from the bearing 214A and may be hardened. The spaces allow selected resilient means placed within to flex and thereby impart a resilient component to the force applied to the sealing lines.

Preferred resilient means include helical springs inside holes 1406, 1406A in the slant shaft (see FIG. 14; a hole and spring is cross-sectioned in FIG. 15*a* at 1501), leaf springs (1503), or elastic masses 1401A and 1401B (FIGS. 15 and 16)—likely to have been moulded in place upon the faceted shaft 208A. The selected resilient means are compressed into contact with corresponding flat or partially cylindrical internal portions 1403 of the slant shaft. Since it is usually preferred that axial movement that is set up along shaft 208A in order to settle the 590 swash plate and inner swash sphere 211 in a position of least imbalance of force arising from the two sealing lines occurs about the needle rollers 214A rather than at the flats 1404, the slanted shaft 208A and the sleeve 1402 may be held in loose axial alignment by known means such as with a circlip. On the other hand, two ball bearing races may be used inside the inner swash sphere instead of the needle rollers 214A. Then the axial movement, which is never 595 large, may instead be allowed at the flat sliding surfaces such as between flats 1403 and 1404.

In FIG. 15, the outer surface of hollow cylinder 1402 comprises the inner race for bearings 214A, and 215A. Note the array of rollers 214A in FIG. 15 that roll against the hardened shell 1502 included inside axial aperture 208B. Needle roller bearings are preferred. 1502 shows a hardened insert that is used as an outer race for the rollers. This mechanism provides a self-contained apparatus for providing a rotating, directional resilient component for the biasing force that closes the sealing lines, to be applied to sphere 211. The direction of resilience rotates, tracking the sealing lines, in phase with rotation of the shaft. as the shaft turns inside the nutating inner swash sphere, transmitting the driving torque of the motor in order to counteract the pumping load on the swash plate. Directional resilience of this type has the advantage that the resilient means is not cycled with each revolution of the common drive shaft but sees a relatively constant compressive force, so that an elastomer is likely to have an extended life. In use, an optimised direction under particular conditions may lead or lag the directions of the sealing lines.

The directionally oriented resilient property of the swash plate driving means is preferably oriented with the greatest resilience aligned and maintained during rotation in the direction of the sealing lines, providing greatest compliance over the sealing positions, and providing the least compliance at about 90 degree phase difference apart from the positions of the swash sealing lines. It has been established by theory and by measurement that for a swash pump that two thrust vectors representing the integrated pressure on the plate are always 90 degrees (a quarter revolution) apart from the position of the two sealing lines (ignoring the moments when the sealing lines traverse the ports), although the direction of the vectors alternate. Minimum resilience is preferred in line with the position of the pumping load thrust vector. Hence the invention is preferably provided with the flats on shaft 208A formed at an angle parallel to the plane shared by both axes of the common shaft so that the direction of least resilience is at 90 degrees to the line joining the sealing lines. Optionally the invention may be provided with the flats on shaft 208A formed at optimised angles other than parallel to the plane shared by both axes of the common shaft. Use of resilience in either a non-directional or preferably a directional manner allows a more compliant force closing the swash plate to cone plate contact to be applied at both sealing lines. In the absence of resilience, greater precision of manufacture and greater dimensional stability during use is required to achieve an equivalent seal.

FIGS. 6 (an axial section through a divider plate), 7 (a radial cross section of the divider/seal assembly), and 8 (the trunnion in perspective) describe the divider plate assembly that provides a stop against rotation of the nutatable swash plate, and maintains an effective barrier between the high-pressure zone (region 228) of the pumping chamber 213 adjacent port 104 (see FIG. 11) and the low-pressure zone in region 229 by the inlet port 105. The three-part divider plate construction has to ensure effective sealing from high to low pressure zones in the pump despite nutating movement of the swash plate across the pumping chamber. The trunnion 802 is a rod-shaped object having a base 603 (FIGS. 6 and 8) which fits rotatably and sealably into a part-circular radial bore cut into the swash plate. The trunnion has a longitudinal slot 801 (see FIG. 8) that encompasses the fixed divider plate assembly. The low-friction divider plate of this invention includes an outer fixed flat part 220 and an inner sliding part 221 (called the divider seal) which are separated by for example a slidable joint (tongue 606 extending from the fixed divider part 220 into a groove inside the divider seal part 221) that also contains the resilient part (wire spring 222) pushing the joint open, and since the outer part 220 is fixed, the resilient 640 means maintains a controlled sealing force on 221 and hence seals against the inner swash sphere.

The specific type of joint should be a firm fit, once assembled in the pump, since otherwise it may allow leakage of the pumped fluid. The trunnion slot 801 also guides movement of the inner divider seal part. The divider plate is fixedly held, without leaks, in slots in the pump housing which press against the housing sides. The seal; part 221 of the divider plate assembly, includes an inner sealing face having a concave, part-spherical surface 607 with a radius matching the outer surface of the inner swash sphere. Preferred materials include a hardened and polished metal plate such as a stainless steel for the fixed divider plate and an engineering plastics material (as described earlier) for the inner divider seal part and for the trunnion 802; hence alternating between metal for the swash plate, plastic for the trunnion, and metal for the divider plate for instance. This three part divider plate assembly has been found to give consistent pump performance with very little friction.

The preferred brushless DC motor (inside housing 101—see FIG. 2) has no commutator and will tolerate some longitudinal displacement of the rotating magnet array (rotor) 225 with respect to the fixed windings wound upon a laminated armature 226 fixed to the base of this motor. Suitable controllers provide variable speed operation which reduces operating costs, and may offer reverse. For prototype purposes, a motor (variant of Wellington Drives type DF 102 three-phase brushless motor; Albany, New Zealand) was modified by pressing the standard supplied motor base off the stator and replacing it with a flameproof motor base (101A-FIG. 2) so that the motor base may be closely re-assembled against the swash pump housing. The stator windings and associated stator position sensors are retained. The standard motor shaft is removed and replaced with the common integrated shaft (see FIG. 3 and related text). The shaft is attached to the motor rotor by a spline or by a keyed connector 306.

Because one intended application for this integrated assembly is the pumping of explosive vapour (as in fuel/air mixtures), and because such a mixture could be ignited at the delivery nozzle, within pipes, or within the pump, this pump should be capable of meeting relevant fire and explosion containment safety requirements. Since one vapour recovery pump may serve two separate filling stations in a single dispenser, an explosion must not propagate from one filling station, through the pump to another filling station. Of course explosion proofing is provided here by way of example and may not be required in all applications.

See FIG. 9 which is a longitudinal section through an entire integrated motor and pump. Explosive vapour will certainly be found, during use, in the pumping chamber 213. The pumping chamber communicates with the exterior through ports such as 104 and 105. Inlet 105 and outlet 104 ports of the swash pump both include a flame arresting filter means 901; preferably a certified commercial product (for example Flammer: Cleebronn, Germany). The integrated assembly is constructed in two separate housings wherein the swash pump itself is confined within a first strong, secure two-part housing (102, 102A) screwed together and sealed with an O-ring seal 102B (FIG. 6, FIG. 11) and an elongated and restricted flame arresting path 102C for confining any flame or explosion occurring within. The motor might generate electric sparks setting off an explosion. Again, the motor interior is contained within a second secure two-part housing 101, 101A, sealed with an O-ring, screwed together and adapted for confining any flame or explosion occurring within. The cable glands at the wiring entry 1100 are also flameproof versions. In any case the combination of a separately housed controller and brushless DC motor abolishes most risk of sparks.

The straight portion 207 of the drive shaft inside the motor is confined as shown in FIG. 9 by a first flame arresting feature comprising a 15 mm elongated metal surround 1101, closely surrounding the shaft (with only 0.15 mm radial clearance), which surround comprises a machined part of the pump housing. A second 25 mm elongated machined metal surround 1102 is located around shaft 207 as it enters the motor cavity through the motor base. (Specific dimensions shown in FIG. 9 refer to the applicant's A05 prototype series).

Variations

A skilled reader will appreciate that many of the developments embodied in the swash pump may be put into practice without having an integrated motor as shown in FIG. 1. Preferably the drive means will allow about a millimeter of axial movement in the drive shaft in order to allow the swash plate and shaft to settle in response to axial forces, as previously described in this section.

Inside the inner swash sphere, a pair of needle roller bearings are preferred since these allow axial sliding. This position minimises the torque applied through the bearings hence allows smaller bearings. Use of a fixed stub axle carried into a bearing external to the sphere and mounted eccentrically from the common drive shaft and at a slant is an option that seems unbalanced and is harder to protect with rotary seals.

An example pump for the intended application works against small pressure differentials, typically about 200 mbar, and needs no valves. Valves are not justified at this relatively low pressure differential and would be an obstacle to passage of the non-compressible fluid (in this example; gasoline). This application also needs to handle non-compressible fluids (liquids). Other applications may handle solid particles like suspended sediments and may involve a higher pressure differential. Both pumping cavities—one on each side of the swash plate—may be effectively combined into one, and use a common (strip) port cut across the swash plate both at the inlet and exhaust. Adiabatic efficiencies may be improved for compressible fluids especially at higher compression ratios. One way valves such as reed valves at the exhaust of the pump may be required. Such valves with appropriate independent porting can stop flow swapping across the swash plate and eliminate reflux or backflow into the pump cavities. At the same time, the porting arrangement should support independent ports for each side of the swash plate. Each side of the swash plate then comprises an independent pumping cavity.

Machined metal parts may be replaced by moulded parts, or parts made of moulded or machined plastics, dependent in part on requirements imposed by the intended application. The reduced precision required permits more use of moulded parts.

A conventional induction motor or indeed any source of rotating power may be used to drive the swash pump.

INDUSTRIAL APPLICABILITY AND ADVANTAGES

Pumps according to the invention have the effect of substantially reducing frictional losses and render the swash pump very much more feasible as a commercial solution in a variety of applications. More particularly.

1) The design is inherently more efficient since the sealing lines between the swash plate and the cone plates are also the position-setting sites for the inner swash sphere, where low friction occurs and pressure is in any case applied for sealing purposes.
2) The design is inherently more efficient since frictional drag on the drive shaft is substantially reduced as compared to other swash pumps.
3) Wear on parts, and lubrication requirements are reduced, so extending life.
4) Manufacturing tolerances are reduced in a number of ways, as previously described.
5) No parts slide in stiff surrounds such that friction with heat expansion can cause thermal runaway and seizure.
6) Incorporation of resilient means within the inner swash sphere and about the slanted section of the drive shaft enhances the above advantages.
7) The parts count is optimised, especially in relation to bearings and to seals.
8) Reduced size (at about ⅓ of the volume, energy waste (at about ⅓) and weight (at about 30%) of a conventional electric motor are advantages conferred by the preferred brushless DC motor.
9) A smaller integrated motor and pump assembly allows retro-fitting into a wider variety of existing dispensers, and other applications.
10) Use of a swash pump design in the vapour recovery application allows for (a) steady fluid displacement, (b) slower mechanical seal contact speeds, (c) a lower noise level (at about 70 dB compared to a prior-art at 80 dB), (d) capability of pumping 745 inadvertently received slugs of liquid without fault, and (e) the two pumping chambers in this Example may be operated as two separate pumping lines in parallel without valves yet delivering a steady flow, not easily achieved with a vane pump or a piston pump.
11) No one-way valves are needed (at least in the intended application) since the sealing lines themselves provide a continuously present seal between the inlet and the outlet at almost all angles of nutation.

Finally, it will be understood that the scope of this invention as described by way of example and/or illustrated herein is not limited to the specified embodiments. Where in the foregoing description, reference has been made to specific components or integers of the invention having known equivalents, then such equivalents are included as if individually set forth. Those of skill will appreciate that various modifications, additions, known equivalents, and substitutions are possible without departing from the scope and spirit of the invention as set forth in the following claims.

We claim:

1. A swash pump adapted for pumping a compressible fluid, comprising:

a nutatable inner swash sphere having an external surface and a central axis and joined to a circumferential swash plate;

an axial aperture of said sphere receiving and supporting driving means;

a circumferential pumping chamber in which the swash plate is sealably confined, the circumferential pumping chamber being defined outwardly by a fixed part-spherical surface comprising an outer swash sphere, at each side by a fixed conical or cone plate;

a fixed divider plate inwardly by the inner swash sphere, which sealably transects the swash plate between the or each inlet port and the or each outlet port;

a common drive shaft such that nutation of said inner swash sphere being biased at an included angle in the common drive shaft between a slanted section and a straight section of said shaft, said straight section being rotatably supported in fixed relation to a housing of the swash pump; and two moving sealing lines such that the fluid being admitted from an inlet port then caused when in use by nutation of the inner swash sphere to be transported around a side of the pumping chamber towards the divider plate by one of the two moving sealing lines each providing complete closure of the pumping chamber between a side of the nutatable swash plate and an adjacent, parallel contact line upon a cone plate until the fluid reaches an adjacent outlet port, one sealing line always 180 degrees apart from, and on the opposite side of the swash plate, from the other sealing line; wherein the or each pumping chamber has a sealing contact formed between the external surface of the inner swash sphere and each of an opposed pair of circular seals, each circular seal being resiliently supported against a pump housing, and the exterior of the inner swash sphere does not form a bearing against the housing.

2. The swash pump as claimed in claim 1, wherein contact at the or each sealing line is made through a non-resilient layer or coating placed between each side of the swash plate and the adjacent cone plate; said layer having a low-friction characteristic, so that during use losses arising from friction acting on the swash plate at the or each sealing line are minimized.

3. The swash pump as claimed in claim 1, wherein the bias causing the swash plate to form the respective sealing line is applied through resilient means at least partially surrounding the slanted portion of the common drive shaft and inside the axial aperture of the inner swash sphere; said resilient means allowing a greater yet more consistent closing force to be applied at each of the sealing lines.

4. The swash pump as claimed in claim 3, wherein the resilient layer surrounds the slanted portion of the common drive shaft inside the axial aperture of the inner swash sphere and is comprised of a series of ring-shaped resilient members, each placed in a corresponding circumferential groove within an outer roller bearing race shell, and held within the axial aperture.

5. The swash pump as claimed in claim 3, wherein said directional means comprises (a) an inner roller bearing race having an axial slotted aperture in a sliding fit over a slanted portion of the common drive shaft bearing diametrically opposed, flattened sliding surfaces; said slotted aperture including two spaces perpendicular to the flattened surfaces each retaining a resilient means in compression against the slanted shaft; the retained resilient means thereby exerting directional resilience in an axial plane parallel to the plane of the diametrically opposed flattened surfaces; said directional resilience being superimposed on the bias applied from the slanted drive shaft on to the swash plate.

6. The swash pump as claimed in claim 5, wherein the directional resilience is directed by forming the diametrically opposed, flattened surfaces in a plane parallel to a plane shared by the axis of the straight portion of the common drive shaft and the axis of the slant portion of the common drive shaft, so that, when in use, the directional resilience is aligned with, and rotates with, the sealing lines formed between the swash plate and the two cone plates.

7. The swash pump as claimed in claim 1, wherein the swash pump comprises part of an integrated pump intimately joined together with an electric motor; the motor and the pump sharing the straight section of the common drive shaft; wherein the common section is coaxial with a rotor of the electric motor and passes through the motor; the straight section is rotatably supported by a first bearing means secured to the pump housing and by a second bearing means secured to the motor, thereby also supporting the rotor in relation to a stator of the electric motor and thereby using the bearings of the straight section of the common drive shaft as the bearings of the motor.

8. The swash pump as claimed in claim 7, wherein the bearing means provided for the slanted section and for the straight section of the common drive allow axial movement of the shaft during use, so that any change of location of the inner swash sphere causes movement of the slanted portion of the common drive shaft and in turn of causing axial movement of the straight portion of the common drive shaft; said axial movement having an effect of reducing friction arising from forces applied to any bearing means during use, and of allowing said one or both sealing lines to determine the position of the inner swash sphere and the axial position of the shaft.

9. The swash pump as claimed in claim 1, wherein the divider plate comprises a fixed peripheral section and a movable central section joined together by means of a telescoping joint biased apart by resilient means; the central section extending inward from the peripheral section and pressing against the surface of the inner swash sphere adjacent the position of a trunnion; the central section being provided with a concave bearing surface having the same radius as that of the inner swash sphere so that the central section forms an effective seal between inlet and outlet ends of each side of the pumping chamber yet friction arising from contact between the sphere and the concave face of the divider plate is minimized.

10. The swash pump as claimed in claim 9, wherein the fixed peripheral section of the divider plate is comprised of a first rigid material having a low coefficient of sliding friction against the slot of the trunnion, while the movable central section is comprised of a second rigid material having a low coefficient of sliding friction against the surface of the inner swash sphere.

11. The swash pump as claimed in claim 1, wherein said inner swash sphere will, when in use, be caused to move along the slanted shaft between the resiliently mounted circular seals and become aligned under influence of a resultant vector of thrust forces arising at one or both said sealing lines between the swash plate and one or both fixed cone plates; while the inner swash sphere and the swash plate are biased into contact with one or both cone plates by the slanted drive shaft.

* * * * *